US008662420B2

(12) United States Patent
Facchin

(10) Patent No.: US 8,662,420 B2
(45) Date of Patent: Mar. 4, 2014

(54) VALVE BODY AND FLUID INJECTOR WITH A VALVE BODY

(75) Inventor: Alessandro Facchin, Pisa (IT)

(73) Assignee: Continental Automotive Italy S.p.A., Fauglia Pisa (IT)

( * ) Notice: Subject to any disclaimer, the term of this patent is extended or adjusted under 35 U.S.C. 154(b) by 736 days.

(21) Appl. No.: 10/597,467

(22) PCT Filed: Dec. 2, 2004

(86) PCT No.: PCT/EP2004/053219

§ 371 (c)(1),
(2), (4) Date: Feb. 14, 2007

(87) PCT Pub. No.: WO2005/075812

PCT Pub. Date: Aug. 18, 2005

(65) Prior Publication Data

US 2007/0278329 A1 Dec. 6, 2007

(30) Foreign Application Priority Data

Jan. 28, 2004 (EP) ..... 04001802

(51) Int. Cl.
*B05B 1/30* (2006.01)

(52) U.S. Cl.
USPC ..... 239/585.5; 239/533.9; 239/900

(58) Field of Classification Search
USPC ..... 239/533.12, 585.4, 585.5, 900, 533.9, 239/533.11, 533.13, 533.14
See application file for complete search history.

(56) References Cited

U.S. PATENT DOCUMENTS

| | | | | |
|---|---|---|---|---|
| 4,007,880 | A | 2/1977 | Hans et al. | 238/585 |
| 4,270,257 | A | 6/1981 | Kimata et al. | 29/157.1 |
| 4,398,670 | A * | 8/1983 | Hofmann | 239/533.9 |
| 4,423,842 | A * | 1/1984 | Palma | 239/585.4 |
| 4,651,931 | A | 3/1987 | Hans et al. | 239/533.9 |
| 4,890,794 | A | 1/1990 | Imafuku et al. | 239/533.12 |
| 4,907,745 | A | 3/1990 | Messingschlager | 239/463 |
| 5,090,625 | A | 2/1992 | Davis | 239/453 |
| 5,551,638 | A | 9/1996 | Caley | 239/453 |
| 5,833,142 | A | 11/1998 | Caley | 239/453 |

(Continued)

FOREIGN PATENT DOCUMENTS

| | | | |
|---|---|---|---|
| DE | 502601 C1 | 7/1930 | F02M 61/04 |
| DE | 859395 C1 | 7/1949 | F02M 61/04 |

(Continued)

OTHER PUBLICATIONS

International Search Report for International Application No. PCT/EP2004/053219 (8 pages), Mar. 2, 2005.

*Primary Examiner* — Christopher Kim
(74) *Attorney, Agent, or Firm* — King & Spalding L.L.P.

(57) ABSTRACT

A fluid injector has a housing, an actuator unit and a valve body. The valve body has a needle (22) and a cartridge (21) with a recess, which takes in the needle (22) and which has on one of its ends a seat plate (213), that has a needle seat (2132) for the inward-opening needle (22), with the needle (22) further having a seat part (221) with a sealing area (222), that is destined to rest on the needle seat (2132) if it is pushed against the needle seat (2132), with the seat part (221) having a cavity radially inwards and in proximity to the sealing area (222).

7 Claims, 3 Drawing Sheets

(56) References Cited

U.S. PATENT DOCUMENTS

| | | | | |
|---|---|---|---|---|
| 6,338,445 | B1 * | 1/2002 | Lambert et al. | 239/533.12 |
| 6,631,854 | B1 * | 10/2003 | Stier | 239/102.1 |
| 6,669,117 | B2 | 12/2003 | Boecking | 239/533.3 |
| 6,772,965 | B2 | 8/2004 | Yildirim et al. | 239/533.3 |
| 6,923,388 | B2 | 8/2005 | Buehler | 239/533.2 |
| 2003/0155442 | A1 | 8/2003 | Faber et al. | 239/533.12 |

FOREIGN PATENT DOCUMENTS

| | | | | |
|---|---|---|---|---|
| WO | 03/002867 | A1 | 1/2003 | F02M 53/04 |
| WO | 03/016707 | A1 | 2/2003 | F02M 61/00 |
| WO | 03/078826 | A1 | 9/2003 | F02M 51/06 |

* cited by examiner

VALVE BODY AND FLUID INJECTOR WITH A VALVE BODY

CROSS-REFERENCE TO RELATED APPLICATIONS

This application is a U.S. national stage application of International Application No. PCT/EP2004/053219 filed Dec. 2, 2004, which designates the United States of America, and claims priority to European application number EP04001802.0 filed Jan. 28, 2004, the contents of which are hereby incorporated by reference in their entirety.

TECHNICAL FIELD

The invention relates to a valve body and a fluid injector. The valve body comprises a needle and a cartridge with a recess, which takes in the needle and which comprises on one of its ends a seat plate, that comprises a needle seat for the inward-opening needle. Fluid injectors, in particular fuel injectors for diesel or gasoline internal combustion engines, comprise a housing, an actuator unit and a valve body. The valve body comprises a needle, that in the case of an outward-opening needle opens or closes a nozzle and in that way controls the injection of fuel. In the case of an inward-opening needle the needle controls the flow of the fluid into a sack volume, which leads to a nozzle.

BACKGROUND

In order to meet the requirements of strict emission legislation and in order to save fuel consumption fluid injectors, in particular fuel injectors for internal combustion engines, are arranged in a cylinder head of the internal combustion engine in a way, that they inject the fuel directly into a combustion chamber of the engine. In order to get a very fine atomization of the fluid in such applications it is necessary to provide the fluid under high pressure. In gasoline internal combustion engines the fluid pressure may reach up to 200 bars, in diesel engines fluid pressure may reach up to 2000 bars.

WO 03/016707 A1 discloses a fluid injector with a connector to a fuel supply, a housing, an actuator unit and a valve body. The housing is double tubed and has a recess, which takes in the actuator unit. The actuator unit comprises a piezoelectric actuator, which acts on the needle. Between the walls of the double tube-shaped housing the fuel is lead from the connector to a fuel inlet of the valve body. The valve body has a housing part with a recess, that takes in the needle. Depending on the position of the needle, which is of an outward-opening type, a nozzle is opened or closed and respectively fuel is injected or not.

Increasingly strict legislation concerning emissions of internal combustion engines, where a valve body or a fluid injector with a valve body is arranged, makes it necessary to put a lot of effort in measures that reduce the emissions. Very important for the prevention of exhaust emissions is that the fluid injectors used for the internal combustion engine can be controlled in a closed position of the needle, in which a fuel leakage is very low.

SUMMARY

The object of the invention is to create a valve body and a fluid injector, which is simple an ensures a very low leakage of fluid through the valve body or respectively the fluid injector.

The object concerning the valve body can be achieved by a valve body comprising a needle and a cartridge with a recess which takes in the needle and which comprises on one of its ends a seat plate that comprises a needle seat for the inward opening needle, wherein the needle further comprises a seat-part with a sealing area that is destined to rest on the needle seat if it is pushed against the needle seat, and wherein the seat-part comprises a cavity radially inwards and in proximity to the sealing area.

The cavity can be formed as a blind hole. The valve body may comprise a filler part that is taken in the cavity. The filler part may protrude into a sack volume formed in the seat plate. The filler part may consist of plastics. The cavity can be formed in an annular shape. Part of the seat part may protrude into a sack volume formed in the seat plate. The seat part can be spherically shaped. The seat part can be formed by a ball with a hole passing through the ball into which the needle is taken in and which forms together with the needle a cavity. A fluid injector may comprise a housing, an actuator unit and such a valve body.

The invention is distinguished by a valve body with a needle and a cartridge with a recess, which takes in the needle and which comprises on one of its ends a seat plate, that comprises a needle seat for the inward-opening needle. The needle comprises a seat part with a sealing area, that is destined to rest on the needle seat, if it is pushed against the needle seat. The seat part comprises a cavity radially inwards and in proximity to the sealing area.

The invention concerning the fluid injector is distinguished by a fluid injector with a housing, an actuator unit and the valve body.

The invention is based on the finding, that the cavity makes the seat part flexible and enables micrometric deformations of the seat part in the needle seat, which improve the sealing quality between the needle seat and the sealing area of the seat part very much.

In an advantageous embodiment of the valve body the cavity is formed as a blind hole. The blind hole is simple to manufacture and improves to a high extent the sealing quality between the needle and the cartridge.

In a further advantageous embodiment of the valve body it comprises a filler part, that is taken in the cavity. This has the advantage that the free space of the cavity is reduced which improves the hot temperature performance of the injector.

Advantageously the filler part protrudes into a sack volume formed in the seat plate. That way the sack volume is decreased, which improves the hot temperature performance of the valve body in particular if it is arranged in a fluid injector.

It is further advantageous, if the filler part consists of plastics. Such a filler part is simple to manufacture and the stiffness of the plastics may be suitably selected in order to achieve a desired flexibility of the seat part in the sealing area.

In a further advantageous embodiment of the invention the cavity is formed in an annular shape. By this the volume of the cavity is reduced, which improves a hot temperature performance of the valve body and respectively the fluid injector. In addition to this a pumping effect is achieved by the annular-shaped cavity when the seat part is pushed with its sealing area against the needle seat of the seat plate. When the needle hits with the sealing area the needle seat, the free space of the annular-shaped cavity is reduced by bending the seat part inwards. The hydraulic resistance for the fluid contained in the annular-shaped cavity is increased by that. There is a flow of fluid out of the annular-shaped cavity which dissipates part of the kinetic energy of the seat part dampening its possible bounces.

It is further advantageous, if part of the seat part protrudes into the sack volume formed in the seat plate in combination with the cavity being formed in annular shape. By this a free space of the sack volume, where the fluid can flow is reduced in a simple way, which improves the hot temperature performance of the valve body.

In a further advantageous embodiment of the invention the seat part is spherically shaped. This ensures a high sealing quality regardless of the needle axis orientation.

It is further advantageous, if the seat part is formed by a ball with a hole passing through, were the needle is taken in and which forms, together with the needle, the cavity. Such balls are widely and cheaply available.

BRIEF DESCRIPTION OF THE DRAWINGS

Exemplary embodiments of the invention are explained in the following with the aid of schematic drawings. These are as follows.

Elements of the same design and function, that occur in different illustrations are identified by the same reference character.

DETAILED DESCRIPTION

Figure 1:
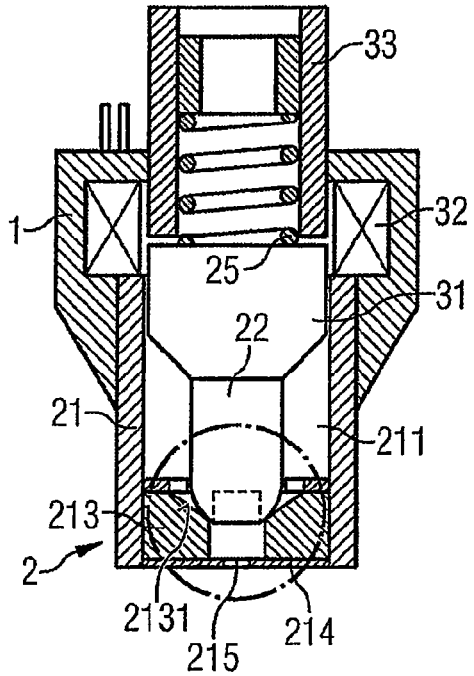
FIG. 1 a first embodiment of a fluid injector with a valve body.

A fluid injector, that is used as a fuel injector for an internal combustion engine, comprises a housing 1, a valve body 2, an actuator unit and a fuel connector. The fuel connector is designed to be connected to a high pressure fuel chamber of the internal combustion engine, where fuel is stored under high pressure, for example under the pressure of about 200 bar.

The housing 1 is preferably formed in a way, that there is a space to lead the fuel from the fuel connector to a fuel inlet of the valve body.

The actuator unit is preferably arranged in the housing. The actuator unit may be of a type known to a person skilled in the art, that is suitable for that purpose. It may, for example, contain a piezoelectric actuator. However, it may alternatively contain an electromagnetic actuator, that comprises an armature 31, a solenoid 32 and a pole element 33. A return spring 25 is arranged and pre-loaded in such a way, that it pushes the armature 31 away from the pole element 33 unless an electromagnetic force created by the solenoid 32 is larger than the pre-loading force of the return spring 25.

The valve body 2 comprises a cartridge 21, which is fixed to the housing 1 at one of its free ends, preferably by welding, especially by laser-welding. The cartridge 21 comprises a recess, which takes in the needle and also serves as a fluid duct. The recess takes in on one of its ends a seat plate 213, which comprises in a conically-shaped area 2131 a needle seat 2132 for an inward-opening needle 22. The needle 22 comprises a seat part 221 with a sealing area 222, that is destined to rest on the needle seat 2132, if the seat part 221 is pushed against the needle seat 2132. The needle 22 is mechanically coupled to the armature 31.

If the needle 22 rests with the sealing area 222 of its seat part 221 in the needle seat 2132, fluid is prevented from flowing into a sack volume 2133, which is limited by respective walls of the seat plate 213 and by a disk 214, which has an injection nozzle 215, through which the fluid can flow out of the valve body 2 from the sack volume 2133.

The seat part 221 comprises a cavity, which is located radially inwards and in proximity to the sealing area 222. The cavity may be formed as a blind hole 223. The blind hole can easily be manufactured by, for example, drilling. By the blind hole 223 the flexibility of the sealing area 222 is increased. Like that micrometric deformations of the seat part 221 in the sealing area 222 are enabled if it contacts the needle seat 2132. This improves significantly the quality of the sealing between the needle seat 2132 and the sealing area 222. Alternatively the cavity may be a centrically-dished area or may be annular-shaped.

Figure 2:
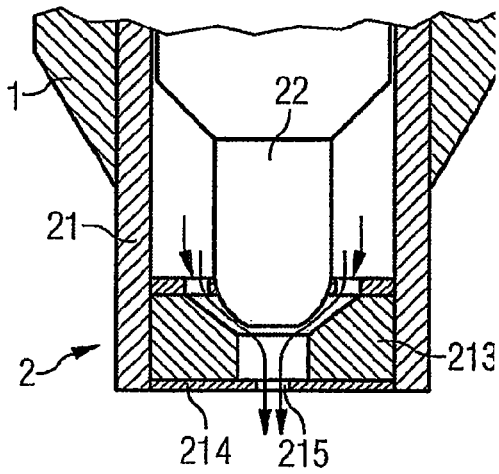
FIG. 2 an enlargement of the valve body according to FIG. 1.
Figure 3:
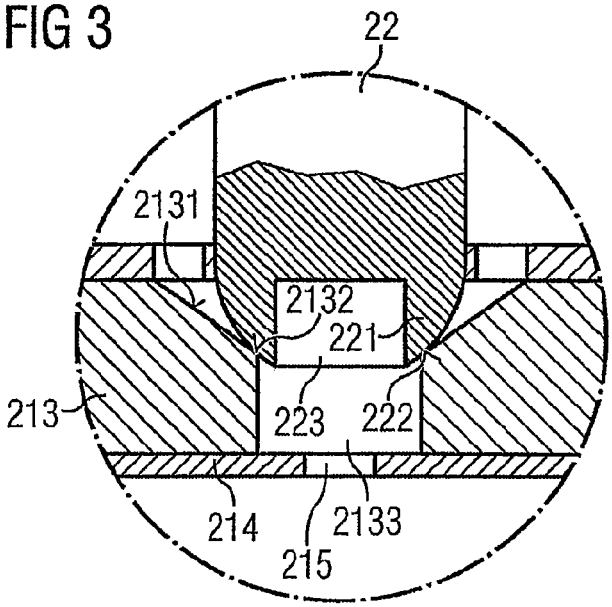
FIG. 3 a further enlargement of parts of the valve body according to FIG. 2, FIG. 4 a second embodiment of the valve body, FIG. 5 the second embodiment of the valve body in a given position, FIG. 6 a third embodiment of the valve body and FIG. 7 a fourth embodiment of the valve body.

FIG. 2 shows the needle 22 in a position, where the sealing area 222 is spaced apart from the needle seat 2132 and fluid flows into the sack volume 2133 and from there exits the valve body through the injection nozzle 215.

Figure 4:
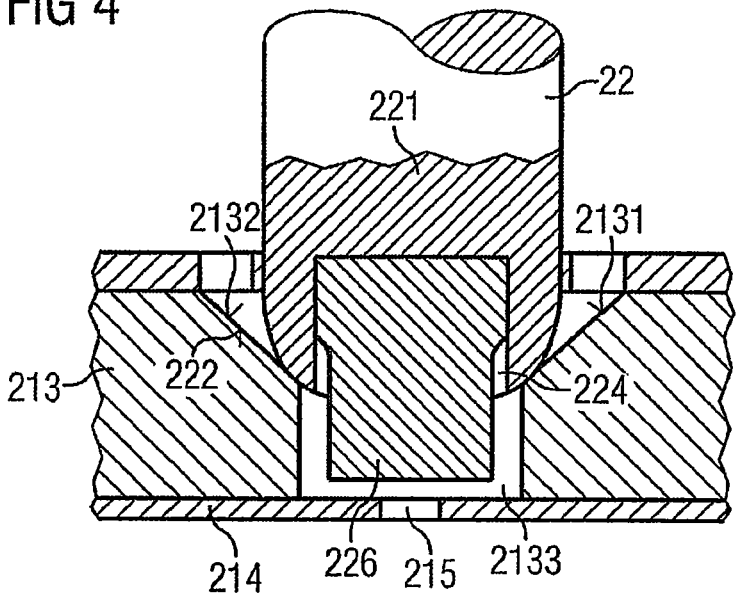

In the embodiment of the valve body 2 of FIG. 4 a filler part 226 is taken in the cavity 223 and fills up the cavity 223 except for an annular-shaped cavity 224, which is formed between a wall of the filler part and the blind hole 223. By this the free space, where fluid can flow off the cavity, which in this case is formed by the annular-shaped cavity 224, is significantly reduced. In combination with a suitable depth of the annular-shaped cavity 224 the right flexibility of the seat part 221 in order to ensure a high quality sealing between the needle seat 2132 and the sealing area 222 is achieved.

In an alternative embodiment the filler part may fill the blind hole 223 also to a greater extent. In this case the material of the filler part 226 needs to be of suitable stiffness in order to achieve the desired flexibility of the seat part 221 of the needle 22. If the filler part has a low enough stiffness it may also fill the whole blind hole 223.

Preferably the filler part 226 protrudes into the sack volume 2133. By this measure the free volume, where fluid can flow into the sack volume, is reduced, which improves the hot temperature performance of the fluid injector. The filler part 226 may, for example, consist of metal or plastic. Plastic has the advantage that it is easy to manufacture and it may be injection-molded in an easy way.

Figure 5:
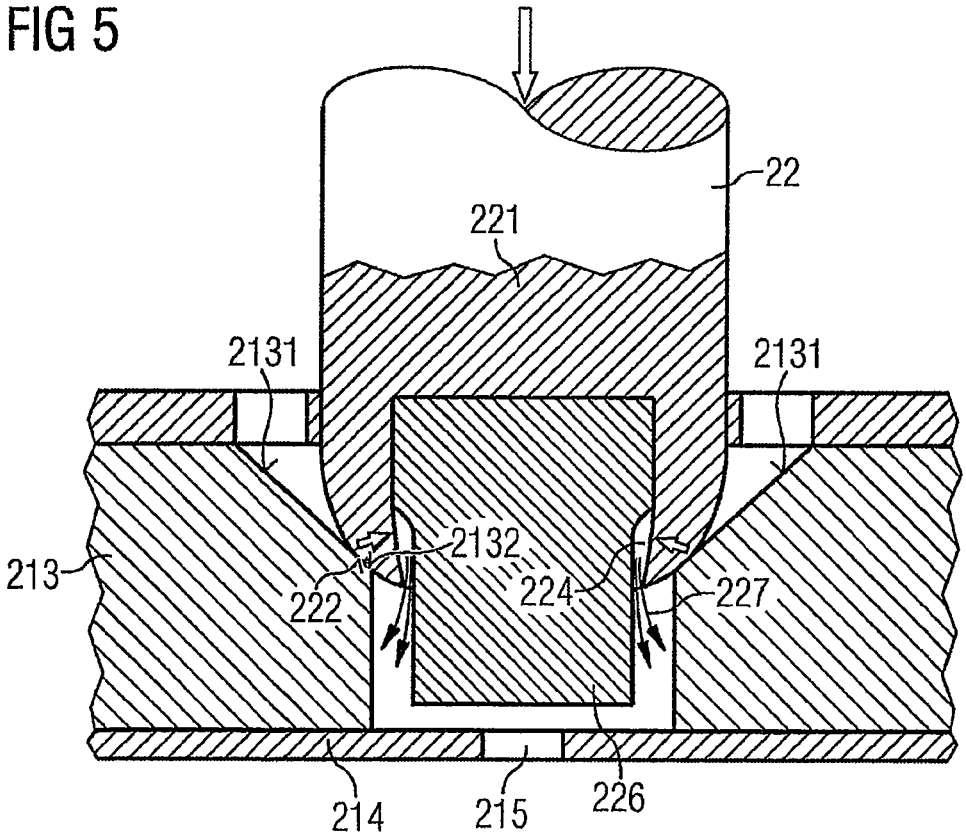
Figure 6:
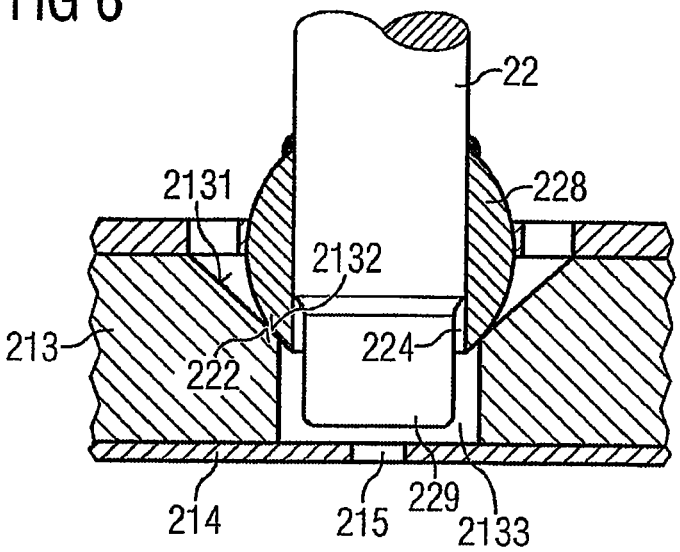

The annular-shaped cavity 224 has in addition the advantage, that when the needle 22 hits with its sealing area 222 of its seat part 221 the needle seat 2132 the seat part 221 is bent inwards as shown in FIG. 5 which reduces the volume of the annular-shaped cavity 224 and increases the hydraulic resistance for the fluid inside the annular-shaped cavity 224, which tends to flow out of the annular-shaped chamber 224 because of the pressure increase due to the impact. The flow of the fluid out from the annular-shaped cavity 224 dissipates a significant part of the kinetic energy of the needle 22 and the seat part 221, dampening its possible bounces.

The seat part 221 may also be spherically-shaped, which improves the sealing quality between the needle seat 2132 and the sealing area 222.

The spherical shape can be easily obtained by forming the seat part 221 out of a ball 228 with a hole passing through the ball, where the needle 22 is taken in and which forms together with the needle 22 the annular-shaped cavity 224. The ball 228 is preferably fixed to the needle 22 by welding. In this embodiment a needle tip 229 may protrude into the sack volume 2133.

Figure 7:
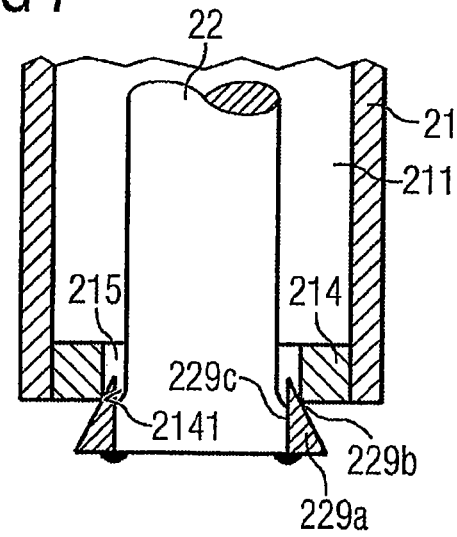

In another embodiment of the valve body 3 (FIG. 7) the needle 22 is of an outward opening type. The cartridge 21 comprises a disk 214 with the injection nozzle 215 being formed in the disk 214. Differently from the other embodiments the needle tip 229A comprises a sealing area 229B, which rests in the closed position of the needle 22 on a needle seat 2141 which is formed in the injection nozzle 215 of the disk 214. An annular-shaped cavity 229C is formed in the needle tip 229A of the needle 22 in proximity to the sealing area 229B radially inwards and in communication with the recess 211. By this measure the flexibility of the needle tip 229A is increased and micrometric tip deformations of the needle in the needle seat 2141 are enabled, which improves the sealing quality between the needle seat 2141 and the sealing area 229B of the needle 22.

What is claimed is:

1. A valve body of a fluid injector comprising:

a needle extending in an axial direction;

a cartridge with a recess which takes in the needle; and a seat plate disposed on one end of the recess, comprising a needle seat for the needle, wherein the needle includes a seat part with a sealing area that rests on the needle seat if it is pushed against the needle seat, wherein the needle includes a cavity comprising a blind hole disposed radially inwards from the sealing area and having an axial length covering in axial extension the sealing area, the cavity defining a circumferential inner sidewall that extends along the axial length and an end opposite the sealing area of the needle, wherein the cavity makes the seat part more flexible in the sealing area as compared to an identical seat part without a cavity, such that ends of the seat part around the cavity flex inwardly due to micrometric deformations of the seat part when engaged in the needle seat, and wherein the cavity is at least partially filled with a material affixed to the circumferential inner sidewall and the end of the cavity such that at least a portion of the material is located between the ends of the seat part that flex inwardly, the material having a stiffness less than a stiffness of the seat part in order to achieve a desired flexibility of the seat part, whereby a seal is formed between the seat part and the needle seat when the seat part is engaged in the needle seat.

2. A valve body according to claim 1, wherein the material affixed to the circumferential inner sidewall of the cavity comprises a filler part.

3. A valve body according to claim 2, wherein the filler part protrudes into a sack volume formed in the seat plate.

4. A valve body according to claim 2, wherein the filler part consists of plastics.

5. A fluid injector comprising:

a housing;

an actuator unit; and a valve body comprising:

a needle extending in an axial direction; and a cartridge with a recess which takes in the needle a seat plate disposed on one end of the recess comprising a needle seat for the needle, wherein the needle further comprises a seat part with a sealing area that rests on the needle seat if it is pushed against the needle seat, wherein the seat part comprises a cavity comprising a blind hole disposed radially inwards from the sealing area and covering in axial extension the sealing area, the cavity being completely defined by one or more inner walls formed in the needle, including a circumferential inner sidewall that extends in the axial direction and an end opposite the seat part of the needle, wherein the cavity makes the seat part more flexible in the sealing area as compared to an identical seat part without a cavity, such that ends of the seat part around the cavity flex inwardly due to micrometric deformations of the seat part when engaged in the needle seat, and wherein the cavity is either completely empty or at least partially filled with a material affixed to the circumferential inner sidewall and the end of the cavity such that at least a portion of the material is located between the ends of the seat part that flex inwardly, the material having a stiffness less than a stiffness of the seat part in order to achieve a desired flexibility of the seat part, whereby a seal is formed between the seat part and the needle seat when the seat part is engaged in the needle seat.

6. A valve body of a fluid injector comprising:

a cartridge with a recess comprising a seat plate disposed on one end of the recess that comprises a needle seat; and a needle movably arranged within the cartridge;

wherein the needle further comprises a tip with a sealing area resting on the needle seat when pushed against the needle seat, wherein the tip comprises a cavity comprising a blind hole disposed radially inwards from the sealing area, the cavity being completely defined by inner walls formed in the needle tip and an end, and wherein the cavity is either completely empty or at least partially filled with a material affixed to the circumferential inner sidewall and the end of the cavity in order to achieve a desired flexibility of the tip such that ends of the needle tip around the cavity flex inwardly due to micrometric deformations of the seat part when engaged in the needle seat, and whereby a seal is formed between the seat part and the needle seat when the seat part is engaged in the needle seat.

7. A fluid injector comprising:

a housing;

an actuator unit; and a valve body, wherein the valve body comprises a needle extending in an axial direction and movably arranged within a cartridge with a recess, a seat plate formed on one end of the recess, the seat plate comprising a needle seat, wherein the needle further comprises a tip with a sealing area resting on the needle seat when pushed against the needle seat, wherein the tip comprises a cavity comprising a blind hole disposed radially inwards from the sealing area, the cavity defining a circumferential inner sidewall that extends in the axial direction and an end, and wherein the cavity is at least partially filled with a material affixed to the circumferential inner sidewall and the end of the cavity, the material having a suitable stiffness in order to achieve a desired flexibility of the tip and to enable micrometric deformations of the seat part when engaged in the needle seat, and whereby a seal is formed between the seat part and the needle seat when the seat part is engaged in the needle seat.

* * * * *